US005186760A

United States Patent [19]

Rubenzer

[11] Patent Number: 5,186,760

[45] Date of Patent: Feb. 16, 1993

[54] CLEANING DEVICE FOR CUVETTES

[75] Inventor: Peter Rubenzer, Salzburg, Austria

[73] Assignee: SLT Labinstruments Gesellschaft m.b.H., Grodig, Austria

[21] Appl. No.: 623,951

[22] PCT Filed: Apr. 3, 1989

[86] PCT No.: PCT/EP89/00358

§ 371 Date: Feb. 4, 1991

§ 102(e) Date: Feb. 4, 1991

[87] PCT Pub. No.: WO90/11831

PCT Pub. Date: Oct. 18, 1990

[51] Int. Cl.[5] ..... B08B 3/04

[52] U.S. Cl. ..... 134/22.18; 134/25.4; 134/166 R; 134/169 R; 15/302

[58] Field of Search ..... 134/166 R, 150, 167 R, 134/168 R, 103, 182, 902, 22.1, 22.18, 25.4, 34; 422/292; 15/304, 302

[56] References Cited

U.S. PATENT DOCUMENTS

| | | | |
|---|---|---|---|
| 3,463,397 | 8/1969 | Mecklin et al. | 134/103 X |
| 3,849,830 | 11/1974 | Wagner | 15/304 X |
| 3,879,795 | 4/1975 | Gfeller | 15/302 |
| 3,916,924 | 11/1975 | McGowan | 134/168 R |
| 3,949,771 | 4/1976 | Dodge et al. | 134/182 |
| 4,106,155 | 8/1978 | Fosslien | 15/304 X |
| 4,341,568 | 7/1982 | Christensen | 15/304 X |
| 4,559,664 | 12/1985 | Bohme et al. | 15/304 X |
| 4,675,053 | 6/1987 | McCarty et al. | 15/302 X |
| 4,685,480 | 8/1987 | Eck | 15/302 X |
| 4,754,771 | 7/1988 | Tangherlini et al. | 15/302 X |
| 4,913,179 | 4/1990 | Engel et al. | 15/302 X |

FOREIGN PATENT DOCUMENTS

| | | | |
|---|---|---|---|
| 1942201 | 7/1970 | Fed. Rep. of Germany | 15/302 |
| 53-29674 | 8/1976 | Japan | 134/902 |
| 60-36676 | 2/1985 | Japan | 134/902 |

OTHER PUBLICATIONS

PCT/US89/03508 Mar./1990 E.P.

*Primary Examiner*—Frankie L. Stinson
*Attorney, Agent, or Firm*—Wenderoth, Lind & Ponack

[57] ABSTRACT

A cleaning device cleans cell accumulations or sediment or cell accumulations with sediment in cuvettes of a microtiter plate. A liquid container supplies a cleaning liquid to a plurality of charging pipes with a pump. The charging pipes dropwise feed the cleaning liquid to the cuvette. Preferably the charging pipes are obliquely disposed relative to the walls of the cuvettes and have a cross-sectional expansion at their discharge openings to enhance the formation of drops. A plurality of pipettes are also provided for suctioning off the cleaning liquid provided to the cuvettes by the charging pipes. The pipettes are capable of having the immersion depth thereof in the cuvettes controlled so as to follow the level of the cleaning liquid down in the cuvettes.

6 Claims, 3 Drawing Sheets

CLEANING DEVICE FOR CUVETTES

BACKGROUND OF THE INVENTION

The invention relates for a cleaning device for curettes, in particular to clean microtiter plates, comprising charging pipes attached to a pump and to a liquid container in order to feed a cleaning fluid and comprising pipettes in order to suck off the liquid. The invention further relates to a process for cleaning a cuvette, in particular a curette of a microtiter plate which contains an accumulation of cells or a sediment, and the cell accumulation contained therein or sediment contained therein.

STATE OF THE PRIOR ART

In medical laboratory technology, the anti-human globulin test (Coombs test) is applied to detect so-called irregular antibodies. In this process a specific quantity of red blood cells is put into the depression of a filter plate.

Following a centrifugation step, the cells are washed carefully several times in order to remove all serum globulins. Subsequently a so-called Coombs serum is added that reacts with the cells.

SUMMARY OF THE INVENTION

The actual measurement is performed in a photometer.

It is clear from the above described example that the washing of the titer plates is an important component of the process of the analysis of the blood samples.

With conventional automatic washers, the cell accumulation was destroyed or rinsed out of the curette during the washing process.

Therefore, the object of the invention is to create a cleaning device and a process, which enable curettes to be washed out and to leave largely uninjured a cell accumulation existing therein. In so doing, the cell accumulation is also supposed to be washed.

The cleaning device according to the invention is characterized by the fact that the cleaning fluid is fed to the curettes drop-by-drop with charging pipes and that the immersion depth of the pipettes into the curettes can be controlled.

The process of the invention provides that a cleaning fluid is released dropwise to the wall of the curette and that this cleaning fluid is sucked off with a pipette, which is inserted deeper into the curette as the liquid level drops.

The charging pipes are oriented in an advantageous manner obliquely relative to the walls of the curette and impinge on the walls. Thus, a drop is prevented from falling directly on the cell accumulation. The distance is chosen in such a manner that the drops drain off continuously on the preferably conical curette wall.

One embodiment of the invention provides that the charging pipes exhibit a passage with a cross sectional expansion shortly before the discharge opening.

The drop formation is promoted by the cross sectional expansion.

Furthermore, it is advantageous to select the material for the charging pipes in such a manner that the material exhibits as large a contact angle as possible (small wetting).

It is provided in an advantageous manner that the cross sectional expansion is about 30% of the diameter of the cylindrical passage.

Another embodiment of the device of the invention provides that the supply line for the cleaning fluid exhibits a passage with variable cross section and that between this passage and the pump a return line leading to the liquid container is attached to the supply line.

The return line is provided in an advantageous manner with an over pressure valve.

BRIEF DESCRIPTION OF THE DRAWINGS

An embodiment of the invention is described in detail with reference to the figures of the accompanying drawings as follows.

DETAILED DESCRIPTION OF THE PREFERRED EMBODIMENT

Figure 1:
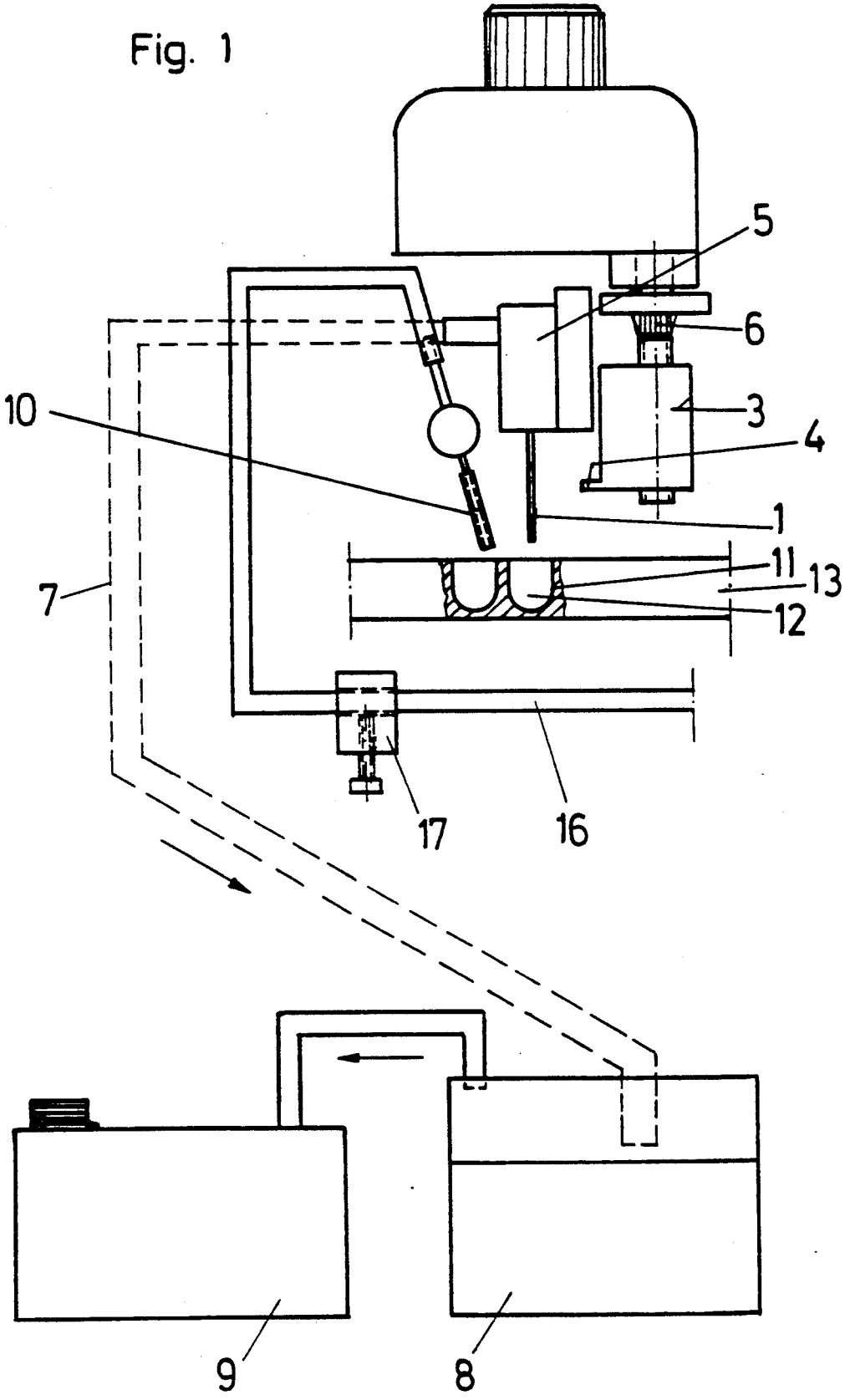
FIGS. 1 and 1*a* show schematically a cleaning device according to the invention.
Figure 1A:
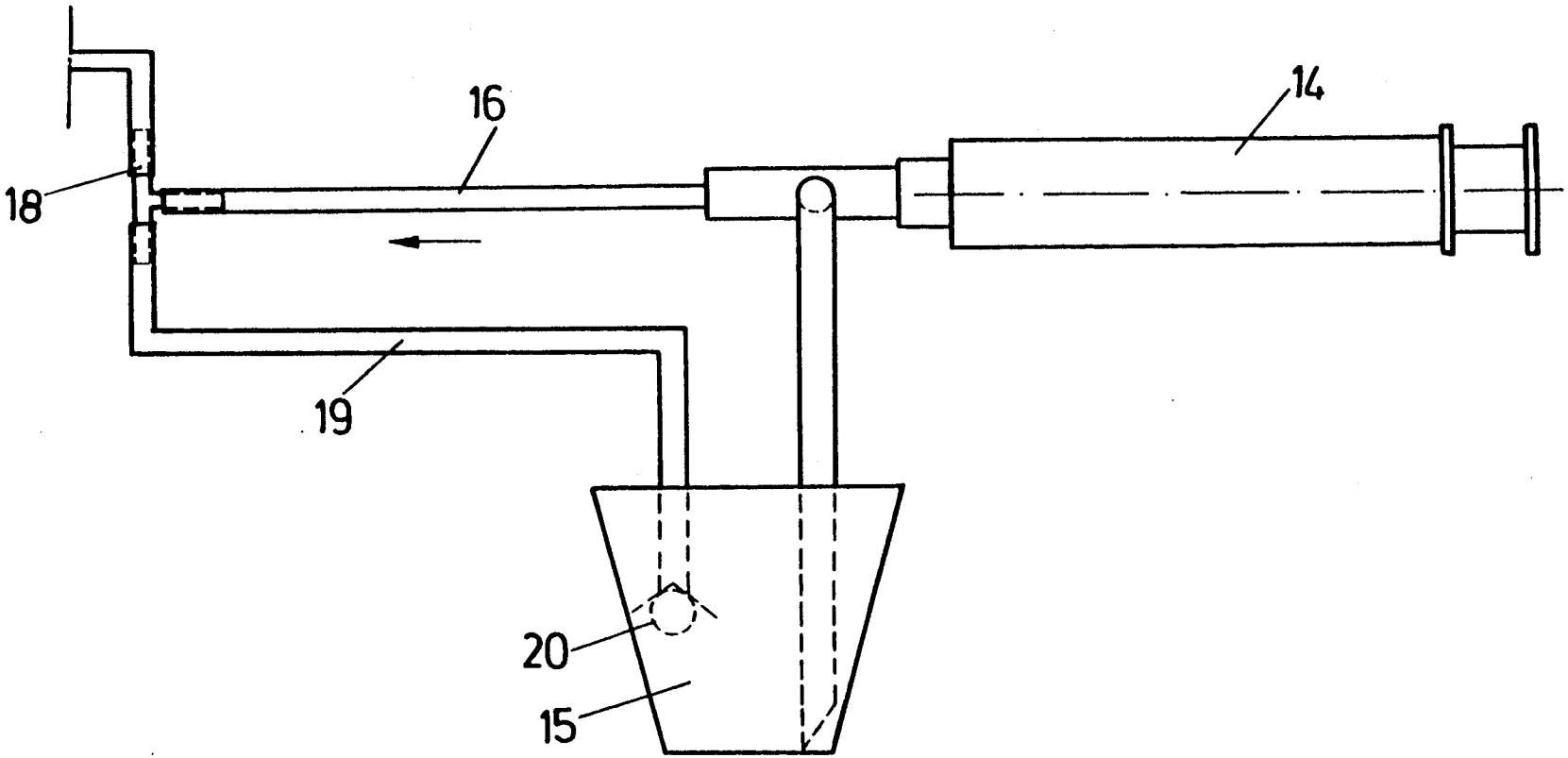
Figure 2:
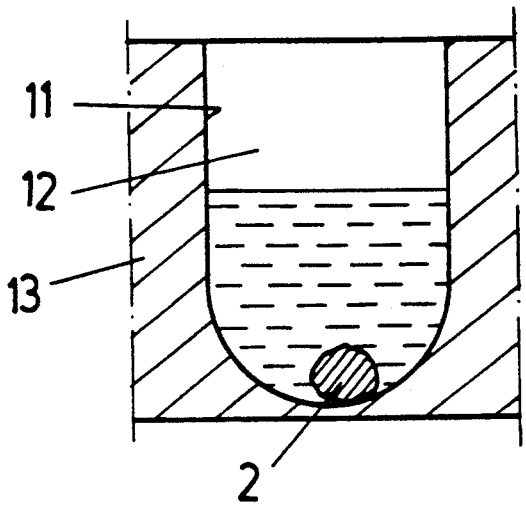
FIG. 2 is a vertical view of a curette with a cell accumulation therein.

FIG. 1 shows only one charging pipe and one curette for suction. The cleaning device according to the invention will be provided in an advantageous manner with a series of pipettes and charging pipes, where the number of charging pipes and pipettes corresponds to the number of curettes in a row of titer plates.

First, the residual liquid is sucked off via pipette 1, and in another working step or in other working steps the rinse liquid is sucked off.

Figure 4:
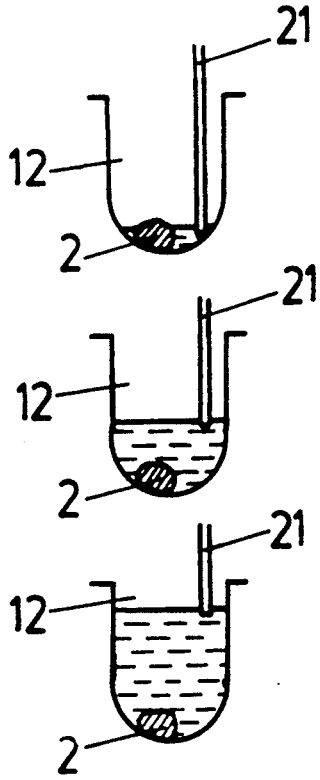
FIG. 4 shows schematically liquid being sucked from the curette.

In so doing, the pipette is lowered to barely below the surface of the liquid and moves downward, as shown in FIG. 4, with the declining liquid level during the suction process. Thus, cell accumulation 2 remains substantially preserved from damage during the suction process.

The suction depth can be set on a scale 6 by means of a depth regulator 3, which has a stop 4 for a pipette holder 5.

The withdrawn liquid is fed via a line 7 to a reduced pressure vessel 8, which is attached to a vacuum pump 9.

As apparent from the figure of the drawings, charging pipe 10 is held at an angle to wall 11 of each curette 12. To fill curette 12 with filling liquid, charging pipe 10 is lowered or the titer plate 13 is raised so that charging pipe 10 is moved closer sideways to wall 11 of a curette (see FIG. 3).

By means of a piston pump 14 rinsing liquid is supplied from a vessel 15 via a line 16 to charging pipe 10.

The quantity of rinsing liquid, which effectively reaches charging pipe 10, is determined by a regulator 17, for example a pinch lock.

Since pump 14 always delivers more liquid than can get to charging pipe 10 or charging pipes 10, a return line 19, which leads to vessel 15, is attached to line 16 at branch 18.

To prevent liquid from draining in an uncontrolled manner from charging pipe 10 or charging pipes 10 via line 19 into vessel 15 between the pumping phases, the return line 19 is provided with an over pressure valve 20, which opens only during the pumping phase.

Figure 3:
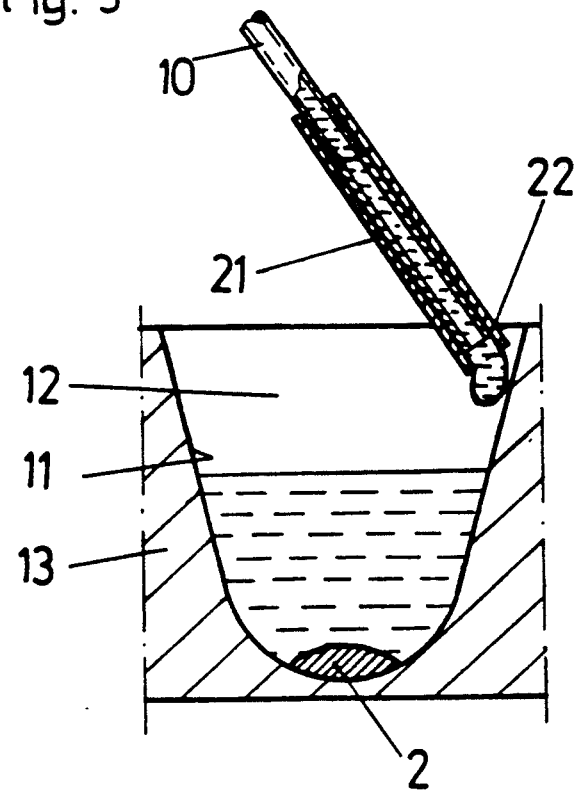
FIG. 3 shows a preferred shape of the curette.

As apparent especially from FIG. 3, charging pipe 10 is provided with a teflon hose 21. The teflon hose 21 results in an increase in the cross section at 22, a feature that promotes drop formation.

The rinsing liquid is fed into or sucked out of a curette 12 at a speed ranging from 25 to 450 $\mu$1 per second.

Once again it is pointed out that the cleaning device according to the invention and the process according to the invention are not restricted in any way to the cleaning of titer plates. It involves only a preferred field of application. The device of the invention and the process of the invention can be applied to any situation in which washings are necessary without destroying cell accumulations in the container or sediments contained therein.

I claim:

1. A cleaning device for cleaning cell accumulations in cuvettes of a microtiter plate, comprising:

a liquid container for supplying a cleaning liquid;

a plurality of charging pipes for dropwise feeding the cleaning liquid to the cuvettes;

a pump connected to said liquid container and said plurality of charging pipes for delivering the cleaning liquid to said charging pipes from said liquid container; and a plurality of pipettes for sucking off the cleaning liquid from the cuvettes, wherein said plurality of pipettes are capable of having the immersion depth thereof in the cuvettes controlled;

wherein said plurality of charging pipes are obliquely disposed so that said charging pipes will be oblique relative to walls of the cuvettes when the cleaning liquid is dropwise fed to the cuvettes, and wherein said plurality of charging pipes each have a liquid passage having a discharge opening therein for feeding the cleaning liquid, said passages have a cross-sectional expansion before said discharge openings.

2. The cleaning device of claim 1, wherein said plurality of charging pipes have a supply line connected to said pump, and a return line is connected to said liquid container and to said supply line between said charging pipes and said pump, said return line having an over pressure valve.

3. The cleaning device of claim 1, wherein said cross-sectional expansion expands by about 30% of the diameter of said passages.

4. A process for cleaning cuvettes containing an accumulation of cells or sediment, comprising the steps of:

providing a liquid container containing a cleaning liquid connected to a plurality of charging pipes, a pump between said container and said charging pipes for pumping the cleaning liquid to said charging pipes and a plurality of pipettes;

delivering the cleaning liquid from said container to said charging pipes with said pump and feeding the liquid to the cuvettes drop by drop along the walls of the cuvette with said charging pipes; and suctioning off the cleaning liquid fed to the cuvettes with said pipettes by gradually inserting the pipettes deeper into the cuvettes, while the pipettes are suctioning the cleaning liquid, along with the drop in the cleaning liquid level in the cuvettes.

5. The process of claim 4, wherein said charging pipes are angled obliquely relative to the wall of the cuvette.

6. The process of claim 4, wherein said charging pipes have a cross-sectional expansion at their discharge openings to promote drop formation.

* * * * *